US008801860B1

(12) United States Patent
Wall

(10) Patent No.: US 8,801,860 B1
(45) Date of Patent: Aug. 12, 2014

(54) METHOD AND KIT FOR RESTORING A VEHICLE HEADLIGHT LENS

(76) Inventor: Thomas M. Wall, Nashville, TN (US)

( * ) Notice: Subject to any disclaimer, the term of this patent is extended or adjusted under 35 U.S.C. 154(b) by 410 days.

(21) Appl. No.: 12/569,113

(22) Filed: Sep. 29, 2009

Related U.S. Application Data

(60) Provisional application No. 61/101,734, filed on Oct. 1, 2008.

(51) Int. Cl.
*B08B 3/04* (2006.01)
*B08B 3/10* (2006.01)

(52) U.S. Cl.
USPC ..... 134/4; 134/26; 359/642

(58) Field of Classification Search
USPC ..... 134/4, 26; 359/642
See application file for complete search history.

(56) References Cited

U.S. PATENT DOCUMENTS 5,523,877 A * 6/1996 Lynam ..... 359/275
5,810,941 A * 9/1998 Moynagh ..... 134/4
6,773,761 B2 * 8/2004 Cote et al. ..... 427/458
6,984,612 B2 * 1/2006 Maillie ..... 510/163
7,163,446 B1 * 1/2007 Cole et al. ..... 451/54
2006/0135735 A1 * 6/2006 Meyer et al. ..... 528/196
2006/0135736 A1 * 6/2006 Meyer et al. ..... 528/196
2006/0201605 A1 * 9/2006 Shadwell ..... 156/98

OTHER PUBLICATIONS

M02-Fine-Cut Cleaner; MSDS No. CHLGR [online]; Meguiar's; Irvine, CA; Feb. 8, 2008 <http://www.autodetailingsolutions.com/M-Line%20MSDS/M02.PDF>.*
N-Methylprrolidone (NPMP). BASF Diols. BASF: The Chemical Company<http://www2.basf.us/diols/bcdiolsnmp.html>.*

* cited by examiner

*Primary Examiner* — Michael Kornakov
*Assistant Examiner* — Katelyn Whatley
(74) *Attorney, Agent, or Firm* — Womble Carlyle Sandridge & Rice LLP

(57) ABSTRACT

A method for restoring a vehicle headlight lens by removing contaminants begins with wiping the lens surface of a vehicle headlight clean. An alcohol-saturated cleaning substance is used to remove debris and pollution from the surface. The alcohol is specifically selected to also remove moisture from the surface of the lens to the greatest extent possible. For optimal cleaning conditions the headlight is heated either by illumination or direct sunlight to a temperature of about 70 to 110 degrees Fahrenheit. A lens restoration solution that includes a dissolving chemical compound such as acetone, methyl ethyl ketone, cyclohexanone and/or tetrahydrofuran is applied to the lens surface, either with an applicator or by spraying. After the lens surface has been restored to a smooth, transparent condition, and adequately hardened, a UV protectant is applied to maintain the lens surface.

5 Claims, 5 Drawing Sheets

45 50 52 54

Headlight Lens Testing Records

| Make | Model | Side | Appearance | Ft- candles before cleaning | Cleaning Method | Ft- candles after cleaning | Restoration Method | Ft- candles after restoration |
|---|---|---|---|---|---|---|---|---|
| Honda | Civic | Right | Good-scratches | 500 | | | | |
| Honda | Civic | Left | Very cloudy | 45 | Alcohol | 50 | Dauber | 490 |
| Ford | Taurus | Left | Cloudy | 150 | Alcohol | 140 | Dauber | 520 |
| Ford | Taurus | Right | Cloudy | 140 | Alcohol | 140 | Spray | 500 |
| Ford | Contour | | Cloudy | 120 | Alcohol | 120 | Dauber | 450 |
| Ford | Taurus | | Cloudy-previously had been treated with some type of abrasive | 290 | Alcohol | 290 | Dauber | 390 |

48 47

Fig. 5

METHOD AND KIT FOR RESTORING A VEHICLE HEADLIGHT LENS

This is a Utility Patent Application filed for the invention by Thomas M. Wall for a "Method and Kit for Restoring a Vehicle Headlight Lens" that claims priority from U.S. Provisional Patent Application Ser. No. 61/101,734 filed Oct. 1, 2008.

BACKGROUND OF THE INVENTION

1. Field of the Invention

The present invention relates generally to a new and improved method and repair kit for restoring a vehicle lens. More particularly, this invention pertains to a method of removing contaminants from a polycarbonate vehicle lens and restoring the lens to a clear condition by at least partially dissolving an exterior surface of the lens with a lens restoration solution.

2. Description of the Prior Art

Automobile headlights are designed to produce a certain level of illumination for night time driving. These headlights each have a lens surface that may deteriorate over time due to ultraviolet (UV) light exposure and oxidization. Upon manufacture, the lens surfaces are coated with a UV protectant to prevent such deterioration. However, over time the effects of weather, pollution, washing and/or other regular use generally remove some of the coating and UV light begins to attack and contaminate the lens surface. If left unchecked, the contaminants may render the lens surface discolored, translucent or otherwise sufficiently opaque to severely reduce effective illumination from the headlight.

One method of treating this problem is simply to replace the headlight. This is not an optimal solution due to the high cost of new headlights, or even of used headlights in the event they are available.

Alternatively, headlights may be physically cleaned so as to remove the contaminants that result from UV light and oxidization. Some form of abrasive action may be undertaken to physically remove the damaged outer surface of the lens. After such a step, the lens is still opaque, and it will be necessary to polish the remaining surface with some type of polishing compound that will allow the lens surface to again become transparent.

A great deal of time is required to perform the dual steps of physically removing the damaged outer surface and subsequently polishing the surface to a satisfactory condition. The process may be overly complicated in the detail required to properly carry it out, and in any event is not desirable in terms of required labor. In many cases, the user may spend hours on such an endeavor. Further, due to the length of time required, many of the headlight lenses do not get adequate reconditioning afterwards, leaving the user with a lens that still does not provide proper illumination. In addition, the abrasive action used to remove the damaged lens surface can leave lens surface distortions which may affect the direction in which the light is projected.

It is desirable, therefore, to provide a new method of removing contaminants from the lens surface of a vehicle headlight that is easier and less time consuming.

It is further desired to provide a new method for preserving a lens surface for a greater period of time after the cleaning process has been undertaken.

It is further desired to provide a new method for removing contaminants from a vehicle headlight so as to enhance the illumination provided by the headlight to that of a new headlight for a fraction of the cost of replacement.

BRIEF SUMMARY OF THE INVENTION

An embodiment of the present application is directed toward a method for restoring a polycarbonate lens which is at least partially opaque from contamination. The user begins by wiping the lens surface of a vehicle headlight clean. Moisture and debris are preferably removed from the lens surface to be treated with an alcohol based cleaner. A lens restoration solution containing a chemical mixture of acetone, methyl ethyl ketone, tetrahydrofuran and/or cyclohexanone is then applied to the cleaned lens surface. Standard PVC primer contains these chemicals but generally has a purple coloring added. Thus, a clear PVC primer can be used as a lens restoration solution if available. However, a purple colored PVC primer is preferably not used as it will cause the lens to become colored and affect the color of the light passing through the lens. Therefore, the ingredients of the primer are preferably mixed without any dies to produce a clear solution. The lens restoration solution is preferably applied with an applicator in single straight strokes across the lens. The applicator can be a polyester tipped dauber, a wool pad or any other suitable material that is compatible with the chemical compounds in the lens restoration solution. The applicator can be rotated between strokes to avoid reintroducing any removed debris to the lens surface. Alternatively, the lens restoration solution may be sprayed on the lens surface with a fine mist sprayer. The lens restoration solution operates to remove the contamination by at least partially dissolving an exterior surface of the polycarbonate lens. The polycarbonate lens preferably heated to a temperature between 70 and 110 degrees Fahrenheit prior to the application of the lens restoration solution. The lens surface is allowed to then harden for a few minutes. Preferably 2 minutes. Cyclohexanone increases the curing time and a mixture without cyclohexanone can be used if a faster curing time is desired. The hardened lens surface is then examined for any untreated sections and the method is repeated only on any identified untreated areas. After the lens surface has been restored to a smooth, transparent condition and a few minutes have passed to permit adequate hardening, a UV protectant is then applied to maintain the lens surface from further deterioration as a result of exposure to ultraviolet light.

A dauber is preferably used as an applicator to apply the primer carefully and evenly to the lens surface in single and continuous motions from one side to the other. The lens restoration solution operates to gather some contaminants on the physical surface of the dauber, while actually dissolving the outer surface of the lens itself. For this reason, best results are obtained where the dauber is rotated slightly after each stroke as the removed damaged plastic will be less likely to redeposit itself onto the lens surface.

The surface will be sticky as the dauber passes and then quickly harden into place afterwards. Therefore, the user should not apply the lens restoration solution too slowly or the dauber might stick to and deform the lens surface. Further, only one coating is desirable lest excessive dissolution of the lens surface occur. However, any sections that have been missed during the first coat should be identified and the lens restoration solution applied. The entire lens is preferably treated before the dauber is re-immersed in the solution.

Another embodiment of the present invention is directed toward a repair kit for repairing a polycarbonate lens. The repair kit includes a lens restoration solution in a container that dissolves an exterior surface of the polycarbonate lens and an applicator for applying the lens restoration solution to the exterior surface of the polycarbonate lens. An alcohol based cleaner is included for cleaning the polycarbonate lens prior to application of the lens restoration solution. The alcohol based cleaner is specifically selected to also remove moisture from the surface of the lens to the greatest extent possible. A UV protectant is also included for application to polycarbonate lens after use of the lens restoration solution. The repair kit comes in a package that encloses the repair kit and a set of instructions for its use. A paper towel for clean up can be included if desired.

BRIEF DESCRIPTION OF THE SEVERAL VIEWS OF THE DRAWINGS

FIG. 5 is a chart showing testing records of various headlights before and after the application of the present invention.

DETAILED DESCRIPTION OF THE INVENTION

Polycarbonate lenses such as those used in vehicle headlight assemblies are vital to providing safe conditions for nighttime driving. Unfortunately, the condition of such lenses will deteriorate over time due to UV light exposure discoloring, oxidization and/or clouding of the lens surface. Further surface contamination may be expected from weather, pollution or other wear and tear. The use of a UV protectant is sufficient to extend the life of a headlight lens for a period, but will eventually be worn away, leaving the lens exposed to the elements. In addition, the UV protectant will not repair existing lens damage.

Figure 1:
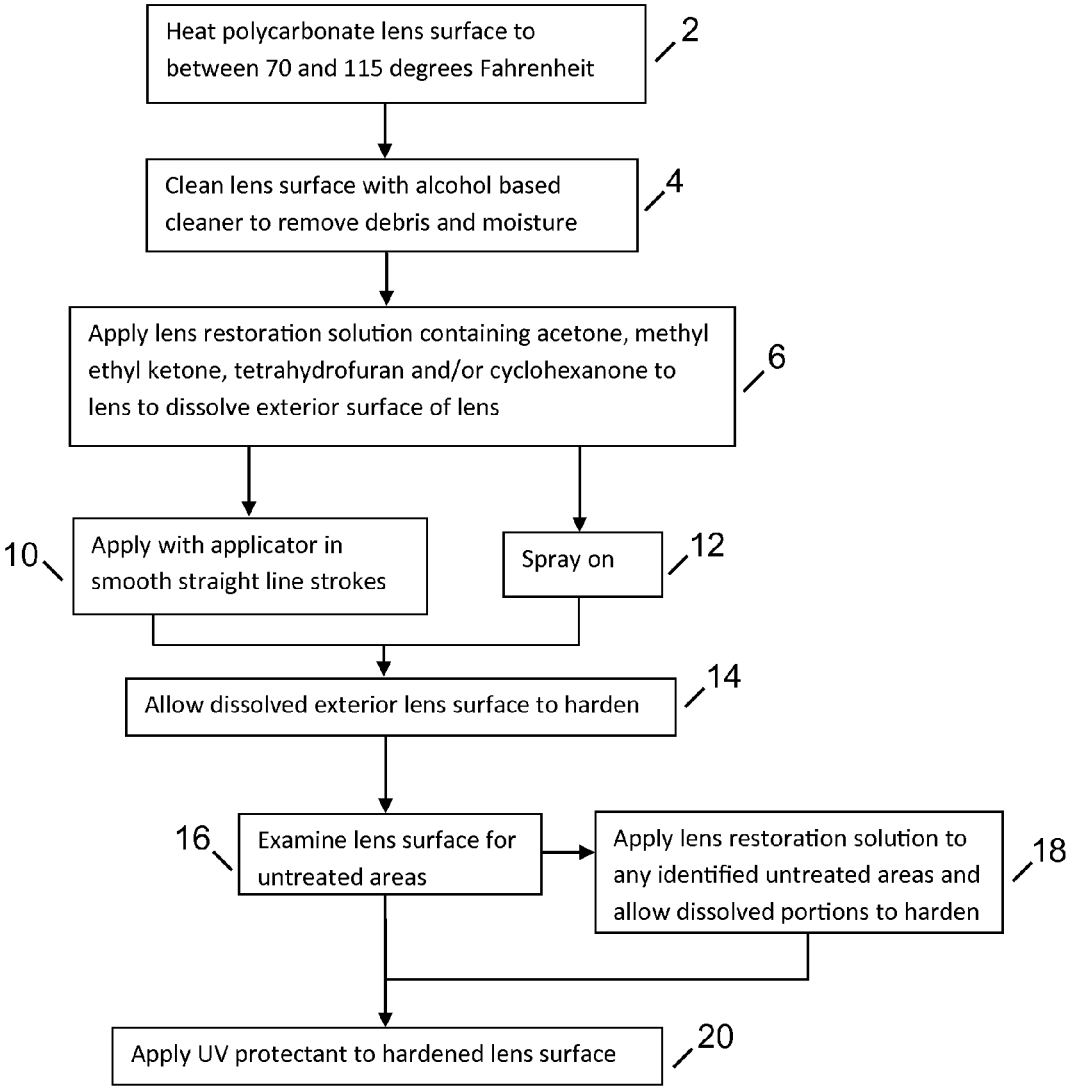
FIG. 1 is a flow chart of a method of restoring a polycarbonate lens in accordance with an embodiment of the present invention.

The present invention offers a simple, quick and relatively inexpensive method for cleaning a polycarbonate lens surface and restoring the headlight to an optimal condition of visibility. Referring to FIG. 1, a preferred method of restoring a lens in accordance with an embodiment of the present invention is shown. The method begins in block 2 with the heating of the polycarbonate lens surface to between 70 and 115 degrees Fahrenheit. Although the method can be performed in a wide range of temperatures, for best performance, the temperature should be above at least 70 degrees Fahrenheit. If the lens is being restored while mounted on a vehicle, the headlight lens can be heated by turning the vehicle headlights on. Alternatively, the vehicle may be turned such that the headlight is directly exposed to sunlight where possible to easily and appropriately heat the lens. If these methods are not available, the lens may be heated to a temperature of 85 degrees Fahrenheit by illuminating or warming the headlights with a heat lamp, heat gun or hair dryer for the required period of time.

Once the lens has been heated as described above, the lens surface is preferably cleaned with an alcohol based cleaner to remove debris and moisture as shown in block 4. While any cleaner will work if the lens is allowed to dry, the alcohol based cleaner allows for immediate application of the lens restoration solution. The cleaning substance may comprise an anhydrous alcohol or other specially denatured alcohol, or any other cleaning agent selected to remove the debris from the surface of the lens while simultaneously refraining from introducing moisture to the lens to the greatest extent possible. Excessive moisture can penetrate below the surface of the lens and result in a cloudy appearance after the method of the present invention has been completed. Thus, an absolute minimum amount of moisture on the lens surface at the time of restoration is desired.

The lens surface of the headlight is cleaned with a cleaning substance so that any surface debris such as dirt or grime may be removed easily before more thorough techniques are undertaken to restore the lens. If the debris is not removed, it may become embedded in the surface of the lens when the surface of the lens is partially dissolved during later steps of the method.

The cleaning substance alternatively may comprise an abrasive pad or fine-grit sandpaper. Using an abrasive, the surface debris may be removed from the lens surface without any adverse chemical reaction or introduction of moisture that might result from a chemical cleaner and potentially cause problems in later steps. It is not necessary to remove all minor scratches from the surface of the lens with the abrasive in any case, as these will be removed in the later steps of the method.

Once the lens surface is relatively clean and moisture has been dried or removed, a chemical compound is applied to recondition the lens surface. A lens restoration solution containing acetone, methyl ethyl ketone, cyclohexanone and/or tetrahydrofuran, such as a clear PVC primer, is preferably applied to the cleaned and heated lens to dissolve the exterior surface of lens as set forth in block 6. The lens restoration solution is preferably applied in single continuous strokes 10 to minimize deformation of the lens surface, or sprayed on 12 to minimize the labor involved in the process. A fine mist sprayer in particular may provide a better looking result with regards to the even application of the reconditioning chemical compound, but does not function to remove contaminants during the process as well as an applicator such as a dauber. The applicator may be any acceptable tool such as a small brush, dauber or pad. A blotter may be used to remove excess solution from the applicator used to apply the solution as discussed below with respect to FIG. 2. The application method selected depends upon the desired results, condition of the lens surface and the desired level of restoration.

The preferred lens restoration solution includes acetone, methyl ethyl ketone, cyclohexanone and tetrahydrofuran. This combination provides optimal transparency characteristics upon application to the lens surface while beginning to vaporize quickly after application such that the chemicals do not penetrate too deeply. While this combination of ingredients provides the best observed results other variations of solvents may perform an equivalent function when used in accordance with the method of the present invention. It is notable that the optimal temperature discussed above applies in light of the preferred lens restoration solution, and other temperatures may be preferable where other suitable solvent combinations are used.

The applied lens restoration solution dissolves the lens exterior surface. In step 14, the dissolved exterior lens surface is allowed to harden. The surface of the lens remains in a sticky and softened condition for a short time after the lens restoration solution has been applied. The lens surface should be allowed to harden for several minutes after application of the restoration solution. The lens restoration solution evaporates quickly and the exterior surface of the lens should be fully hardened in a matter of minutes, typically two, depending upon conditions. This permits the lens surface to form a smooth, transparent shape without the risk of deforming the surface while it is still sticky and softened from the lens restoration solution. Further, the lens restoration solution vaporizes with sufficient speed that the chemicals do not penetrate deeply into the surface as long as they are evenly applied.

As shown in step 16, the hardened lens surface is examined to identify any untreated areas on the lens surface. If any untreated areas are identified in the lens surface, the method proceeds to step 18 wherein the lens restoration solution is applied to any untreated areas and the dissolved portions are allowed to harden. If the method is being performed by a consumer without much experience in the process, step 18 should be omitted since the initial application will produce very satisfactory results and there is chance of permanently damaging the lens if the primer is repeatedly or excessively applied to the lens exterior surface.

A UV protectant is applied to the hardened lens surface in block 20. After the lens surface has hardened, the layer of UV protectant is preferably applied to protect the lens and replace any factory applied UV protectant removed by the weathering, cleaning and/or lens restoration solution. This prevents the UV rays from the sun from causing undue damage in the short term, although some deterioration will of course occur as time passes. The UV protectant also serves the purpose of filling small scratches or voids in the surface and therefore rendering the surface smooth and easy to clean in the future. The UV protectant of the present invention may be any commercially available UV protectant designed for use on polycarbonate plastic surfaces.

Figure 2:
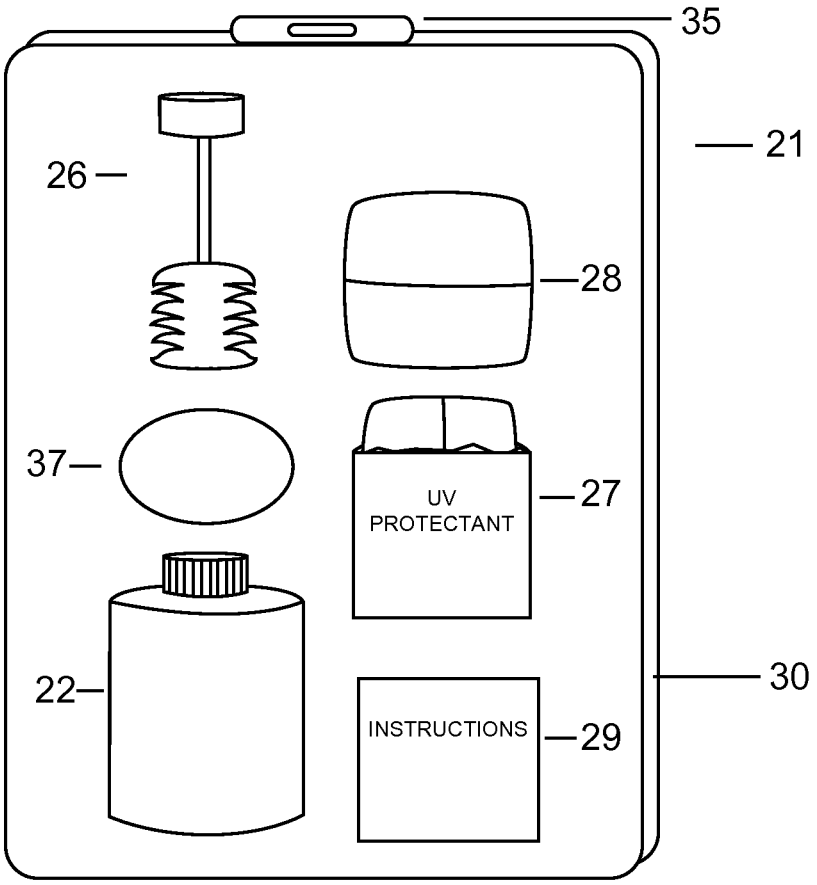
FIG. 2 is an illustration of a lens restoration kit in accordance with an embodiment.

Referring now to FIG. 2, an illustration of a lens restoration kit in accordance with an embodiment of the present invention is shown. The restoration kit 21 includes a bottle of lens restoration solution 22 with an applicator 26, a cloth or paper blotter 37 for removing excess solution from the applicator 26, a package containing a solution with UV protectant 27, a package containing a cloth or paper lens preparation wipe with an alcohol based cleaner 28 and a set of directions 29 contained within a package 30. The package preferably has a peg hook 35. While shown in single use packages, the UV protectant 27 and alcohol based cleaner 28 can be packaged in any suitable container such as a tube or bottle. The restoration kit 21 provides all the components and instructions necessary for a user to perform the method of FIG. 1 other than a paper towel which can be included if desired.

Figure 3:
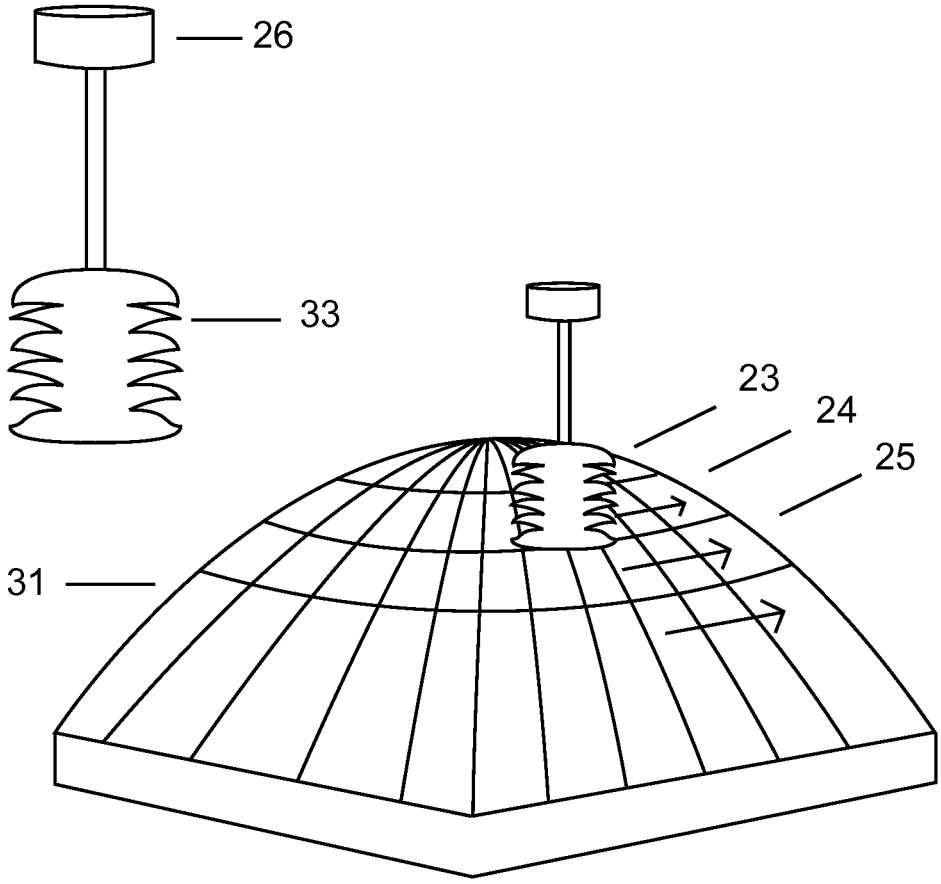
FIG. 3 is an illustration of the preferred application technique of a dissolving lens restoration solution to the lens surface in accordance with the present invention.

FIG. 3 is an illustration of the preferred application technique of a dissolving compound to the lens surface in accordance with the present invention. The dauber 26 is used to apply the lens restoration solution in the bottle 22 to the lens surface 31. The dauber 26 should be preferably touched against the blotter 37, shown in FIG. 2, to eliminate any excess solution on the dauber 26 that might overly dissolve the lens surface or lead to dripping. The solution is preferably applied in single continuous strokes 23, 24 and 25 from one side of the lens surface 31 to the other. This process is repeated sequentially from top to bottom until the entire lens surface 31 has been completely covered. The process should not be repeated, and areas that have already been covered 23, 24, 25 should not be covered a second time. For best results, the lens restoration solution should not be reapplied to any particular lens for at least 30 days after the last restoration. The ingredients of the lens restoration solution react with the outer polycarbonate plastic surface of the lens as they are applied, and tend to dissolve away the oxidized surface upon contact. The lens restoration solution operates to gather some contaminants on the physical surface of the applicator 26, while actually dissolving the outer surface of the lens 31. For this reason, best results are obtained where the applicator is rotated slightly after each stroke as the damaged plastic is less likely to redeposit itself onto the lens surface. The surface will be sticky as the applicator passes and then quickly harden into place afterwards. Therefore, the user should not apply the lens restoration solution too slowly or the applicator might stick to and deform the lens surface. Further, only one coating is desirable. Extended or repeated contact will cause the lens to become opaque or cloudy.

A dauber style applicator 26 having a polypropylene, polyester or wool tip 33 is preferably used as an applicator due to its ability to apply a single even layer of the reconditioning chemical compound to the lens 31 and pick up contaminants as it travels along the surface. The applicator will actually accumulate discolored contaminants from the surface as it passes along the lens. For optimal results the dauber 26 should be rotated slightly after each stroke to prevent redepositing contaminants from the lens surface 31 onto other sections of the surface. This occurs where the surface is sticky and softened from the lens restoration solution and is susceptible to contaminants that have similarly failed to harden and remain on the applicator.

Figure 4:
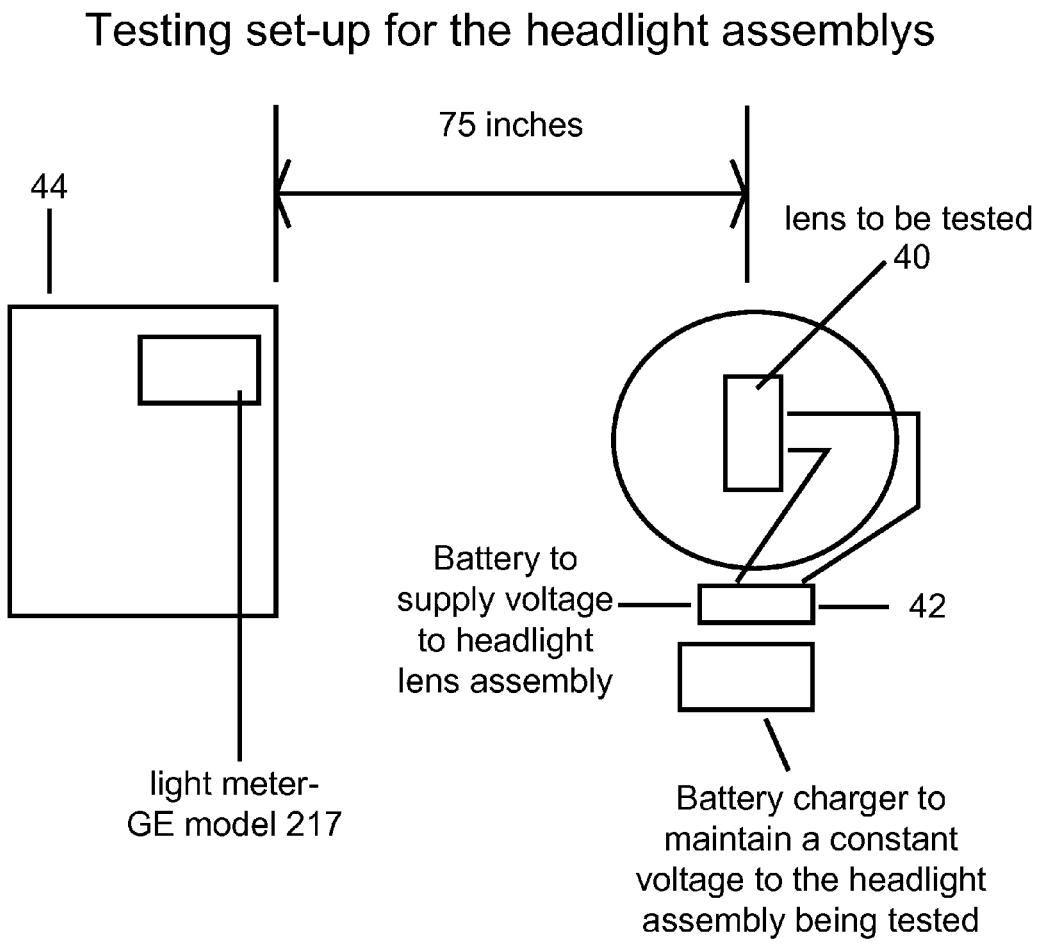
FIG. 4 is a diagram of a testing setup for headlight assemblies subjected to the method of the present invention.

Turning now to FIG. 4, a set up for evaluating a headlight lens restored in accordance with present invention is shown. Headlight lenses suffering from various levels of oxidation were tested to demonstrate the benefits of the present invention. To test the headlight lenses, headlight assemblies 40 having lenses are connected to a power supply such as a battery charger 42 and positioned a constant distance, such as 75 inches, from a light meter 44. The battery charger 42 is used to supply a constant power supply voltage to the headlight assembly 40. The light meter 44, a GE model 217 in the setup shown, is positioned to receive the light from the headlight assembly 40. In the present example the light meter is set up 75 inches from the lens.

The high side of each headlight assembly 40 was used for all tests. The headlight assembly 40 was further rotated and tilted to reach the maximum ft-candle illumination for each test. A ft-candle reading was taken for each headlight assembly 40 before treatment, after the cleaning step of the preferred embodiment of the present invention had been performed, and once again after the entire treatment had been completed and the lens surface fully dried.

FIG. 5 is a table of test results obtained using the test set up of FIG. 4 for a series of polycarbonate lenses. Each column in the table contains the test results for a specific lens suffering from a different amount of oxidation and wear and tear. The first listed lens 48 was in new condition already and was not treated. The other five documented lenses 47 were each measured in an initial state, cleaned with alcohol and measured again, and then finally restored with the above described method of applying lens restoration solution and measured one last time. Column 50 list the foot-candles of light measured through the lens prior to cleaning with alcohol. Column 52 list the foot-candles of light measured through the lens after cleaning with alcohol. Column 54 list the foot-candles of light measured through the lens after restoration with a lens restoration solution. In each case, the headlight either regressed in clarity or failed to substantially improve after cleaning but prior to application of the Lens restoration solution. Also, in each case, application of the lens restoration solution significantly improved the ft-candle measurement in a matter of minutes to approximately the same condition as the first, untreated, un-oxidized lens.

It is to be understood that the present invention is not explicitly limited to the embodiment illustrated in the detailed description given above. Various changes and modifications may be made to the method and kit of for restoring a vehicle headlight lens without departing from the spirit and scope of the invention as defined in the following claim.

What is claimed is:

1. A method for restoring a polycarbonate lens, the polycarbonate lens being at least partially opaque from oxidation contamination, the method comprising:

removing moisture and debris from a lens surface of said polycarbonate lens to be treated;

applying a lens restoration solution to the lens surface to be treated, the lens restoration solution comprising at least one of acetone, methyl ethyl ketone, cyclohexanone, and tetrahydrofuran, the lens restoration solution being operable to at least partially remove the oxidation contamination on contact by at least partially dissolving an exterior surface of said polycarbonate lens and evaporating to allow said partially dissolved exterior surface to harden into a smooth and transparent condition; and applying a protectant to the surface to be treated, the protectant operable to protect the lens from ultraviolet light.

2. The method of claim 1 further comprising the step of removing excess lens restoration solution from an applicator used to apply said lens restoration solution with a blotter.

3. The method of claim 1 wherein the step of removing moisture and debris from said lens surface to be treated further comprises cleaning the lens surface with an alcohol based cleaner.

4. The method of claim 1 further comprising the step of heating said polycarbonate lens prior to the application of said lens restoration solution.

5. The method of claim 1 wherein the lens restoration solution is applied in single continuous strokes.

* * * * *